United States Patent [19]

Marty

[11] Patent Number: 4,812,070

[45] Date of Patent: Mar. 14, 1989

[54] BRUSH AND SCRAPER ATTACHMENT FOR FAUCET SPRAY HANDLE

[75] Inventor: Garry R. Marty, Noblesville, Ind.

[73] Assignee: Masco Corporation of Indiana, Indianapolis, Ind.

[21] Appl. No.: 52,447

[22] Filed: May 21, 1987

[51] Int. Cl.[4] ..... A46B 11/00; A46B 11/02; A46B 11/06

[52] U.S. Cl. ..... 401/289; 401/6; 401/18; 401/25; 401/195; 401/268; 401/288; 401/290

[58] Field of Search ..... 401/289, 25, 26, 27, 401/40, 42, 43, 136, 282, 285, 288, 290, 6, 195, 279, 15, 18, 268; 239/397, 288.5

[56] References Cited

U.S. PATENT DOCUMENTS

| | | | |
|---|---|---|---|
| 1,570,761 | 1/1926 | McCormack | 401/290 X |
| 1,578,449 | 3/1926 | Leraas | 401/288 X |
| 1,598,811 | 9/1926 | Ferrin | 401/289 X |
| 1,642,933 | 9/1927 | McGrath | 401/42 X |
| 1,741,435 | 12/1929 | Rickersberg | 401/136 |
| 1,819,157 | 8/1931 | Fitter | 401/286 |
| 1,901,812 | 3/1933 | Huey | 401/285 |
| 2,266,902 | 12/1941 | Perkins | 401/43 X |
| 2,511,684 | 6/1950 | Amore | 401/6 |
| 2,528,599 | 11/1950 | Loether | 401/290 |
| 2,748,411 | 6/1956 | O'Brien | 401/279 X |
| 2,807,816 | 10/1957 | O'Brien | 401/15 |
| 2,822,559 | 2/1958 | Manville | 401/288 |
| 2,922,178 | 1/1960 | Kelly | 401/290 X |
| 3,041,655 | 7/1962 | Entler | 401/289 X |
| 4,311,404 | 1/1982 | Kodera | 401/289 X |

FOREIGN PATENT DOCUMENTS

| | | | |
|---|---|---|---|
| 1130391 | 9/1956 | France | 401/136 |
| 1368767 | 6/1964 | France | 401/43 |
| 88817 | 3/1937 | Sweden | 401/288 |
| 565318 | 11/1944 | United Kingdom | 401/289 |
| 1321670 | 6/1973 | United Kingdom | 401/290 |

*Primary Examiner*—Steven A. Bratlie

*Attorney, Agent, or Firm*—Edgar A. Zarins; Steven L. Permut; Malcolm L. Sutherland

[57] ABSTRACT

A brush and scraper attachment for a hand-held auxiliary sprayer associated with a kitchen faucet. The brush attachment fits over the nozzle end of the sprayer while the scraper is received within the brush attachment. A seal ring seated within the fluid passageway of the brush provides a sealing engagement between the brush and sprayer to prevent back flow particularly upon attachment of the scraper. The scraper attachment includes a restricted flow passage which supplies water to the scraper blade.

16 Claims, 1 Drawing Sheet

BRUSH AND SCRAPER ATTACHMENT FOR FAUCET SPRAY HANDLE

BACKGROUND OF THE INVENTION

I. Field of the Invention

This invention relates to attachments for an auxiliary spray handle associated with a kitchen faucet and sink and, in particular, to brush and scraper attachments for the faucet spray handle.

II. Description of the Prior Art

Kitchen sinks have long been provided with auxiliary spray handles connected to the water supply of the faucet. Normally, the spray handle is retractable from the sink and connected to the water supply by a flexible hose which permits simple handling of the sprayer. The spray handle includes an operating handle which initiates flow when depressed. In this manner, the sprayer may be operated independently of the faucet in order to clean residual food from plates or to pre-rinse drinking glasses and the like prior to thorough cleaning. In addition, the spray handle can be utilized to rinse the sink following clean-up.

Despite the convenience provided by the auxiliary spray handle, the cleaning force is provided solely by the force of the water flow. Although in most instances this force is sufficient to pre-rinse dirty dishes, dried and more stubborn food residues may require scrubbing action. In such instances, a separate hand held brush or dishcloth must be utilized in conjunction with the spray handle. Some spray handles may be provided with an integrally formed brush or similar scraping utensil. However, these utensils interfere with fluid flow thereby rendering the sprayer inconvenient for use as a simple spray mechanism. Moreover, the integrally formed utensils do not alleviate the problems in already installed or older spray handles.

SUMMARY OF THE PRESENT INVENTION

This invention overcomes the disadvantages of the previously known auxiliary spray handles by providing detachable tools adapted to facilitate removal of residual food in order to pre-rinse plates and glasses.

The present invention generally comprises separate brush and scraper attachments for an auxiliary faucet spray handle. The brush attachment includes a central fluid passageway and peripheral brush bristles. A specially adapted seal ring seated within an interior annular groove provides a sealing engagement between the brush attachment and the sprayer. The brush attachment fits over the outlet end of the spray handle such that fluid flow is directed through the central fluid passageway. The seal ring is configured to sealingly engage the nozzle end of the sprayer and includes an annular shoulder which cooperates with the annular groove formed between the nozzle end and a nozzle sleeve. In this manner, back flow between the sprayer and attachment is eliminated.

Although the brush attachment may be utilized by itself with the spray handle, a scraper attachment is also provided for removal of stubborn food from eating or cooking dishes. The scraper attachment includes a tubular flow housing and a scraper blade. The tubular housing includes an outlet port at the end thereof which allows water to flow over the scraper blade. In this manner, a continuous supply of water is provided during scraping. The scraper attachment is matingly received within the central fluid passageway of the brush attachment such the the inlet end of the tubular flow housing abuts against the nozzle end of the sprayer. As a result, fluid flow is directed into the flow housing of the scraper and out over the scraper blade. Because the outlet port of the flow housing will restrict fluid flow, the seal ring prevents back flow past the sprayer.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invnetion when read in conjunction with the accompanying drawing, in which like reference characters refer to like parts throughout the views, and in which.

DETAILED DESCRIPTION OF A PREFERRED EMBODIMENT OF THE PRESENT INVENTION

Figures 1, 2, 3, 4, 5, 6, 7:
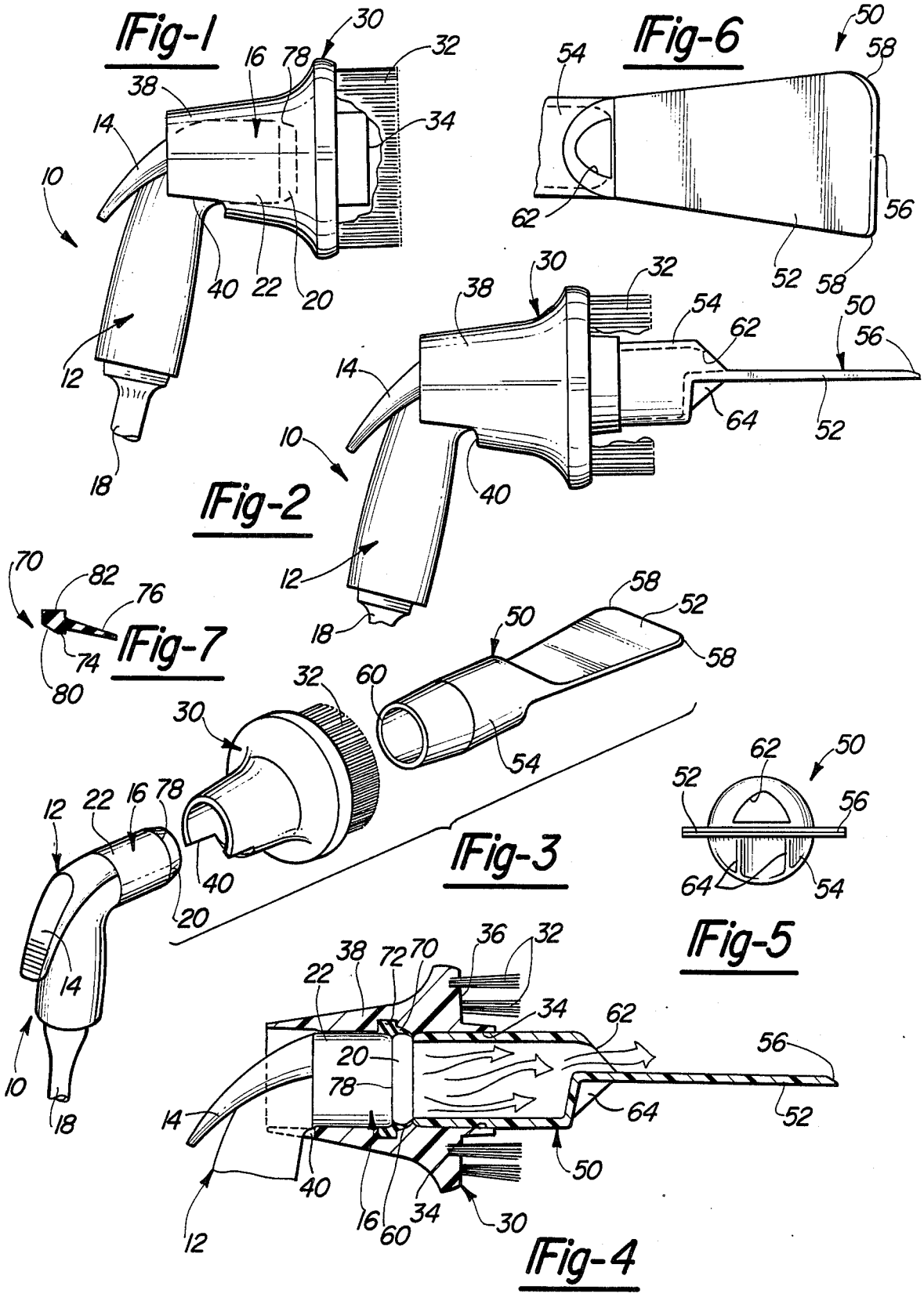
FIG. 1 is a side view of the brush attachment of the present invention mounted to an auxiliary faucet spray handle.
FIG. 2 is a side view of the brush and scraper attachments of the present invention mounted to a faucet spray handle.
FIG. 3 is an exploded perspective of the spray handle embodying the present invention.
FIG. 4 is a cross-sectional perspective of the spray handle embodying the present invention.
FIG. 5 is an end view of the scraper attachment of the present invention.
FIG. 6 is a partial plan view of the scraper attachment of the present invention.
FIG. 7 is a cross-sectional perspective of the seal ring of the present invention.

Referring first to FIGS. 1 through 4 above, there is shown the cleaning attachments embodying the present invention mounted to an auxiliary spray device 10. The spray device 10 is of the type normally found in conjunction with kitchen sink and faucet assemblies for pre-rinsing or pre-cleaning eating accessories such as dishes, utensils and drinking glasses. The spray device 10 normally comprises a hand-held sprayer 12 with a manually operated remote fluid flow control member 14 and a discharge nozzle 16. Water is supplied to the sprayer 12 by a retractable fluid conduit 18 which is connected to the water supply associated with the faucet. In a preferred embodiment of the sprayer 12, the discharge nozzle 16 comprises a nozzle end member 20 and a nozzle sleeve member 22. Although the present invention is described in conjunction with a kitchen pre-rinse spray device, it is to be understood that the attachments may be utilized with other types of sprayer device.

The cleaning attachments embodying the present invention preferably comprise a brush attachment 30 and a scraper attachment 50. As is shown in FIG. 1, the brush attachment 30 may be utilized alone or in conjunction with the scraper attachment as shown in FIG. 2. The brush attachment 30 includes a plurality of brush bristles 32 arranged in a annular configuration in peripheral relation to a central fluid passageway 34. In this fashion, water will flow through the passageway 34 while the brush bristles 32 can engage the surface to be cleaned. Alternatively, the entire face 36 may be provided with bristles 32 and a plurality of flow ports between the bristle groups in order to provide more efficient cleaning action. However, with this alternative embodiment the brush attachment 30 could not be used in conjunction with the scraper attachment 50 as will be subsequently described.

The main body of the brush attachment 30 includes a mounting sleeve 38 adapted to matingly receive the discharge nozzle 16 of the sprayer 12. The mounting sleeve 38 is axially aligned with the fluid passageway 34 to form a substantially uniform central passage. The mounting sleeve 38 includes a removed portion or notch 40 in order to accommodate the angular configuration of the sprayer 12 while ensuring complete engagement between the brush attachment 30 and the sprayer 12.

Referring now to FIGS. 2 through 6, the scraper attachment 50 is mounted to the spray device 10 by inserting it into the fluid passageway 34 of the brush attachment 30. The scraper attachment 50 generally comprises a scraper blade 52 and a tubular flow housing 54 integrally formed therewith. The scraper blade 52 preferably includes a bevelled edge 56 and a pair of corner edges 58 of different configurations to facilitate scraping of pan edges of different configurations. The flow housing 54 includes an open first end 60 and a discharge port 62 formed at the other end of the flow housing 54. In a preferred embodiment, the discharge port 62 is a restricted flow discharge formed on one side of the scraper blade 52 such that water will flow over one side of the blade 52. However, it is within the scope of the present invention to provide dual discharge ports 62 on opposite sides of the blade 52. In the preferred embodiment, support flanges 64 are provided opposite the port 62 in order to strengthen the scraper blade 52. As shown in FIGS. 2 and 4, the tubular housing 54 of the scraper attachment 50 is matingly received within the fluid passageway 34 of the brush attachment 30. Upon insertion of the scraper attachment 50, the open end 60 of the tubular housing 54 substantially abuts against the discharge nozzle 16 of the sprayer 10 such that fluid flow is directed into the flow housing 54 and out the discharge port 62 across the scraper blade 52.

In order to prevent fluid leakage past the discharge nozzle 16 of the sprayer 12 and to positively lock the brush attachment 30 to the spray device 10, the fluid passageway 34 includes a seal ring 70 seated within an annular groove 72. The seal ring 70 is designed to sealingly and lockingly engage the discharge nozzle 16 and is illustrated in FIGS. 4 and 7. The preferred embodiment of the seal ring 70 comprises an inner annular lip 74 and a sleeve portion 76. The lip 74 is adapted to engage an annular groove 78 formed between the nozzle end member 20 and the nozzle sleeve member 22. Since the groove 78 is found on all conventional spray devices 10, the seal ring 70 facilitates locking engagement between the brush attachment 30 and the sprayer 12. the sleeve portion 76 of the seal ring 70 converges inwardly such that a sealing engagement with the nozzle end member 20, which also generally converges inwardly, is ensured. In order of facilitate insertion of the nozzle 16 within the fluid passageway 34 and the seal ring 70, the seal ring includes a sloped forward surface 80. Finally, the seal ring 70 may include substantially rectangular outer shoulder 82 to ensure that the seal is not pulled from the annular groove 78 upon removal of the brush attachment 30 from the spray device 10.

Thus, the seal ring 70 of the present invention provides positive sealing between the brush attachment 30 and the sprayer 12 while also locking coupling these components. To assemble the device, the brush attachment 30 is first placed over the nozzle 16 of the sprayer 12 with the notch 40 positioned downwardly to receive the handle of the device 10. A the brush 30 is attached, the sloped surface 80 of the seal will engage the nozzle end member 20. With continued movement the seal ring 70 will be compressed outwardly until the annular lip 74 passes over the nozzle end member 20 to engage the groove 78 formed in the nozzle 16. With the brush attachment 30 secured to the sprayer 12 the scraper attachment 50, at the option of the user, can be attached by inserting the flow housing 54 into the fluid passageway 34.

The foregoing detailed description has been given for clearness of understanding only and no unnecessary limitations should be understood therefrom as some modifications will be obvious to those skilled in the art without departing from the scope and spirit of the appended claims.

I claim:

1. An improved cleaning attachment having a fluid passageway, said cleaning attachment detachably mountable to a hand-held auxiliary fluid spray device associated with a faucet and having a discharged nozzle, the improvement comprising:

a seal ring seated within said fluid passageway of said cleaning attachment, said seal ring including an outer shoulder adapted to lockingly seat within an annular groove formed in said fluid passageway of said cleaning attachment, an inner annular lip adapted to lockingly engage the discharge nozzle of the spray device, and a sleeve flap portion extending from said outer shoulder and inner lip, said sleeve flap portion extending between said fluid passageway and said discharge nozzle to prevent fluid flow past said seal ring, said cleaning attachment being detachable secured to the discharge nozzle of the spray device.

2. The cleaning attachment as defined in claim 1 wherein said seal ring is integrally formed, said inner annular lip formed on said seal ring and adapted to detachably engage an annular groove formed on the discharge nozzle of the spray device, said inner lip seating within the annular groove of the discharge nozzle such that said fluid passageway of said cleaning attachment is concentrically mounted to the discharge nozzle of the spray device.

3. The cleaning attachment as defined in claim 2 wherein said sleeve flap portion is integrally formed with and extending from said outer shoulder and inner lip, said sleeve flap portion sealingly engaging the discharge nozzle of the spray device.

4. The cleaning attachment as defined in claim 3 wherein said cleaning attachment is a brush attachment having a plurality of brush bristles circumferentially disposed about said fluid passageway, said seal ring being removably seated in said annular groove of said brush attachment to detachably secure said brush attachment to the spray device while preventing fluid flow past said seal ring.

5. A cleaning attachment detachably mountable to a hand-held auxiliary fluid spray device of a faucet construction, the spray device having a discharge nozzle, said cleaning attachment comprising:

a brush attachment having a plurality of brush bristles circumferentially disposed about a central fluid passageway, said fluid passageway adapted to receive the nozzle of the spray device such that fluid flow is directed from the discharge nozzle through said fluid passageway of said brush attachment; and a seal ring for lockingly and sealing securing said brush attachment to the discharge nozzle of the spray device such that fluid flow past said seal ring is prevented thereby directing fluid flow through said fluid passageway and past said brush bristles, said seal ring seated within an annular groove formed in said fluid passageway of said brush attachment and detachably engaging the discharge nozzle of the spray device.

6. The cleaning attachment as defined in claim 5 wherein said seal ring includes a main body portion and an integrally formed sleeve flap portion, said main body portion having an outer shoulder adapted to lockingly seat within said annular groove of said fluid passageway and an inner annular lip adapted to lockingly engage the discharge nozzle.

7. The cleaning attachment as defined in claim 6 wherein said sleeve flap portion comprises a converging annular flap extending from said main body portion, said annular flap sealingly engaging the discharge nozzle.

8. The cleaning attachment as defined in claim 5 wherein said brush attachment includes a mounting sleeve axially aligned with said fluid passageway, said mounting sleeve including a removed portion whereby said mounting sleeve matingly receives the fluid spray device.

9. The cleaning attachment as defined in claim 8 and further comprising a scraper attachment, said scraper attachment matingly received in said fluid passageway of said brush attachment.

10. The cleaning attachment as defined in claim 9 wherein said scraper attachment comprises a flow housing and a scraper blade, said flow housing having an open first end and a discharge port formed in a second end to direct fluid flow from the discharge nozzle of the spray device across said scraper blade.

11. The cleaning attachment as defined in claim 10 wherein said open first end of said flow housing abuts the discharge nozzle of the spray device whereby fluid flow is directed from the discharge nozzle into said flow housing of said scraper attachment and out said discharge port onto said scraper blade, said seal ring preventing fluid flow past said flow housing of said scraper attachment.

12. The cleaning attachment as defined in claim 11 wherein said discharge port of said flow housing is formed on only one side of said scraper blade.

13. A cleaning attachment detachably mountable to a hand-held auxiliary spray device associated with a faucet construction, the spray device having a fluid flow control member and a discharge nozzle, said cleaning attachment comprising:

a brush attachment having a central fluid passageway extending through said brush attachment, said fluid passageway including a mounting sleeve portion adapted to receive the spray device, said brush attachment including a plurality of circumferentially disposed brush bristles said brush attachment mounted to the spray device such that fluid flow is directed from the discharge nozzle through said fluid passageway;

a seal ring seated within said fluid passageway of said brush attachment, said seal ring including an outer annular shoulder adapted to lockingly seat within an annular groove formed within said fluid passageway, an inner annular lip for lockingly engaging the discharge nozzle of the spray device when said spray device is mounted within said fluid passageway, and a sleeve flap portion integrally formed with and extending from said shoulder and lip and adapted to sealingly engage the discharge nozzle wherein fluid flow past said seal ring is prevented; and a scraper attachment matingly received in said fluid passageway of said brush attachment, said scraper attachment comprising a scraper blade and a tubular flow housing directing fluid flow from the discharge nozzle across said scraper blade.

14. The cleaning attachment as defined in claim 13 wherein said sleeve flap portion of said seal ring is a converging annular sleeve integrally formed with said annular shoulder and lip, and adapted to sealingly engage the discharge nozzle.

15. The cleaning attachment as defined in claim 13 wherein said brush attachment is mountable to the spray device independent of said scraper attachment.

16. The cleaning attachment as defined in claim 13 wherein said scraper attachment is matingly retained within said brush attachment by an interference fit.

* * * * *